US009809779B2

(12) United States Patent
Delbridge

(10) Patent No.: US 9,809,779 B2
(45) Date of Patent: Nov. 7, 2017

(54) LUBRICATING COMPOSITION CONTAINING AN ACYLATED POLYALKYLENE OXIDE

(71) Applicant: The Lubrizol Corporation, Wickliffe, OH (US)

(72) Inventor: Ewan E. Delbridge, Concord Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/655,098

(22) PCT Filed: Dec. 16, 2013

(86) PCT No.: PCT/US2013/075245

§ 371 (c)(1),
(2) Date: Jun. 24, 2015

(87) PCT Pub. No.: WO2014/105467

PCT Pub. Date: Jul. 3, 2014

(65) Prior Publication Data

US 2015/0337230 A1 Nov. 26, 2015

Related U.S. Application Data

(60) Provisional application No. 61/746,245, filed on Dec. 27, 2012.

(51) Int. Cl.
*C10M 141/02* (2006.01)
*C10M 165/00* (2006.01)

(52) U.S. Cl.
CPC ..... *C10M 141/02* (2013.01); *C10M 165/00* (2013.01); *C10M 2205/022* (2013.01); *C10M 2205/04* (2013.01); *C10M 2207/028* (2013.01); *C10M 2207/262* (2013.01); *C10M 2207/28* (2013.01); *C10M 2209/103* (2013.01); *C10M 2209/104* (2013.01); *C10M 2215/064* (2013.01); *C10M 2215/10* (2013.01); *C10M 2215/28* (2013.01); *C10M 2219/022* (2013.01); *C10M 2219/046* (2013.01); *C10M 2223/045* (2013.01); *C10N 2230/02* (2013.01); *C10N 2230/06* (2013.01); *C10N 2230/08* (2013.01); *C10N 2230/10* (2013.01); *C10N 2230/12* (2013.01); *C10N 2230/36* (2013.01); *C10N 2230/42* (2013.01); *C10N 2230/43* (2013.01); *C10N 2230/45* (2013.01); *C10N 2230/52* (2013.01); *C10N 2240/10* (2013.01); *C10N 2240/102* (2013.01); *C10N 2240/103* (2013.01)

(58) Field of Classification Search
CPC ..... C10M 141/02; C10M 165/00; C10M 2205/04; C10M 2207/028; C10M 2207/262; C10M 2207/28; C10M 2209/103; C10M 2209/104; C10M 2215/064; C10M 2215/10; C10M 2215/28; C10M 2219/022; C10M 2219/046; C10M 2223/045; C10N 2230/02; C10N 2230/06; C10N 2230/08; C10N 2230/10; C10N 2230/12; C10N 2230/36; C10N 2230/42; C10N 2230/43; C10N 2230/45; C10N 2230/52; C10N 2240/10; C10N 2240/102; C10N 2240/103
See application file for complete search history.

(56) References Cited

U.S. PATENT DOCUMENTS

| | | | |
|---|---|---|---|
| 2,620,302 | A | 12/1952 | Harle et al. |
| 2,620,304 | A | 12/1952 | Stewart et al. |
| 2,620,305 | A | 12/1952 | Stewart et al. |
| 2,681,315 | A | 6/1954 | Tongberg et al. |
| 2,833,717 | A | 5/1958 | Whitacre et al. |
| 2,921,027 | A | 1/1960 | Brennan et al. |
| 3,004,917 | A | 10/1961 | Fefer et al. |
| 3,088,911 | A | 5/1963 | Staffin et al. |
| 3,784,474 | A | 1/1974 | Houston et al. |
| 3,933,662 | A | 1/1976 | Lowe et al. |
| 4,305,835 | A | 12/1981 | Barber et al. |
| 4,402,845 | A | 9/1983 | Zoleski et al. |
| 4,438,005 | A | 3/1984 | Zoleski et al. |
| 4,479,882 | A | 10/1984 | Zoleski et al. |
| 4,493,776 | A | 1/1985 | Rhodes et al. |
| 4,973,414 | A | 11/1990 | Nerger et al. |
| 5,397,486 | A | 3/1995 | Small et al. |

(Continued)

FOREIGN PATENT DOCUMENTS

DE 1012719B B 7/1957

OTHER PUBLICATIONS

Written Opinion of the Corresponding International Application No. PCT/US2013/075245 dated Jun. 3, 2014.

(Continued)

*Primary Examiner* — Cephia D Toomer
(74) *Attorney, Agent, or Firm* — Michael A. Miller; Christopher D. Hilker

(57) ABSTRACT

The invention provides a lubricating composition comprising an oil of lubricating viscosity, 0.1 wt % to 10 wt % of an overbased detergent, and 0.01 wt % to 5 wt % of a non-hydroxy terminated acylated polyalkylene oxide. The invention further relates to a method of lubricating a mechanical device (such as an internal combustion engine) with the lubricating composition. The invention further relates to the use of the non-hydroxy terminated acylated polyalkylene oxide to provide at least one of (i) improved sludge handling, (ii) reduced lead or copper corrosion, (iii) increased oxidation resistance, (iv) improved acid control, (v) reduced wear (such as cam wear or lifter wear), (vi) retention of total base number of the lubricant, and/or (vii) improved seal compatibility in an internal combustion engine.

13 Claims, No Drawings

(56) References Cited

U.S. PATENT DOCUMENTS

| | | | | |
|---|---|---|---|---|
| 6,784,143 | B2 * | 8/2004 | Locke | C10M 129/10<br>508/460 |
| 8,168,572 | B2 * | 5/2012 | Thoen | C10M 111/04<br>508/456 |
| 2011/0245122 | A1 * | 10/2011 | Strickland | C08G 16/02<br>508/370 |

OTHER PUBLICATIONS

Search Report of the Corresponding International Application No. No. PCT/US2013/075245 dated Jun. 3, 2014.
Corresponding International Publication No. WO2014/105467 A1 Published Jul. 3, 2014.

* cited by examiner

LUBRICATING COMPOSITION CONTAINING AN ACYLATED POLYALKYLENE OXIDE

FIELD OF INVENTION

The invention provides a lubricating composition comprising an oil of lubricating viscosity, 0.1 wt % to 10 wt % of an overbased detergent, and 0.01 wt % to 5 wt % of a non-hydroxy terminated acylated polyalkylene oxide. The invention further relates to a method of lubricating a mechanical device (such as an internal combustion engine) with the lubricating composition. The invention further relates to the use of the non-hydroxy terminated acylated polyalkylene oxide to provide at least one of (i) improved sludge handling, (ii) reduced lead or copper corrosion, (iii) increased oxidation resistance, (iv) improved acid control, (v) reduced wear (such as cam wear or lifter wear), (vi) retention of total base number of the lubricant, and/or (vii) improved seal compatibility in an internal combustion engine.

BACKGROUND OF THE INVENTION

Detergents and dispersants are known to assist in maintaining reduced amounts of deposits on engine components. The lubricant industry has a number of engine tests used to evaluate lubricant's ability to handle deposits and sludge including the Sequence VG, Sequence IIIG, Volkswagen TDI, Caterpillar 1N, and Mercedes Benz OM501LA.

With recent changes to engine specifications there is an increasing demand on the lubricant to reduce deposits. For instance, the ILSAC GF-5 specification requires a 4.0 piston merit rating in the Sequence IIIG (vs. 3.5 for GF-4).

U.S. Pat. No. 3,933,662 (Lowe, published 20 Jan. 1976) discloses monoester polyalkoxylated compounds combined with alkaline earth metal carbonates dispersed in a hydrocarbon medium to provide lubricating compositions of superior acid neutralizing capability and rust inhibition in internal combustion engines. The internal combustion engine tested is a Sequence IIB engine. The Sequence IIB engine test evaluates valve guide rust and pitting.

U.S. Pat. No. 4,305,835 (Barber et al, published 15 Dec. 1981) discloses lubricating oil composition for use in the crankcase of an internal combustion engine, having improved resistance to the formation of emulsion-sludge in the area under the engine rocker cover, which contains the combination of an oxyalkylated alkylphenol-formaldehyde condensation product and an oxyalkylated trimethylolalkane.

U.S. Pat. No. 4,402,845 (Zoleski et al., published 6 Sep. 1983) discloses improved spreadability of marine diesel cylinder oils by the incorporation therein of a polyethylene glycol of the formula: $R—CH_2O—(CH_2CH_2O)_nH$ wherein n ranges from 7 to 40 and R is an alkyl group containing from 11 to 15 carbon atoms.

U.S. Pat. No. 4,438,005 (Zoleski et al., published 20 Mar. 1984) discloses improved spreadability of marine diesel engine cylinder lubricants by the incorporation therein of a spreadability improving amount of at least one polyoxyethylene ester of the formula: wherein n ranges from 18 to 22 and R is an alkyl group having 11 to 17 carbon atoms in the chain.

U.S. Pat. No. 4,479,882 (Zoleski et al., published 30 Oct. 1984) discloses improved spreadability of marine diesel cylinder oils by the incorporation therein of a spreadability improving amount of a polyalkoxylated phenoxy compound having the formula: wherein R is an aliphatic hydrocarbyl group having from 5 to 70 carbon atoms and n ranges from 14 to 30.

U.S. Pat. No. 4,493,776 (Rhodes, published 15 Jan. 1985) discloses a lubricating composition with improved rust and corrosion inhibition comprising an additive that is a combination of (A) $R^1O[C_2H_4O]_xH$ and/or $R^2O[C_3H_6O]_yH$ with (B) $R^3O[C_2H_4O]_x[C_3H_6O]_yH$ and/or $R^4O[C_3H_6O]_y[C_2H_4O]_xH$, wherein $R^1$, $R^2$, $R^3$ and $R^4$ are hydrocarbyl radicals selected from alkyl, aryl, alkaryl, and arylalkyl groups or combinations thereof having from about 10 to about 24 carbon atoms; and wherein x and y may vary independently in the range from 3 to about 15. The additives are hydroxyl-terminated.

U.S. Pat. No. 4,973,414 (Nerger et al., published 27 Nov. 1990) discloses monofunctional polyethers having hydroxyl groups contain, as built-in terminal groups or monomers, (a) 1 to 30% by weight of one or more C4- to C24-alkylmonophenols, (b) 1 to 30% by weight of one or more C8- to C24-monoalkanols, (c) 1 to 30% by weight of one or more C10- to C20-1,2-epoxyalkanes and (d) 45 to 80% by weight of propylene oxide or a lower alkylene oxide mixture consisting mainly of propylene oxide the sum of components (a) to (d) adding up to 100% by weight, and have average molecular weights of 600 to 2,500.

U.S. Pat. No. 5,397,486 (Small, published 14 Mar. 1995) discloses a method for inhibiting wear of silver wrist-pin bearings in a two-cycle railroad diesel engine which method comprises lubricating the internal portion thereof with a lubricating oil composition consisting essentially of: a single or multi-grade oil of lubricating viscosity; a sufficient amount of a calcium overbased sulfurized alkylphenate composition so that the total base number in the lubricating oil composition is from about 5 to about 30; and a wear-inhibiting amount of at least one lubricating oil soluble and compatible compound based upon a hydroxy-terminated polyalkylene oxide having 2 to 6 carbon atoms.

Polyalkoxylated compounds are also disclosed in U.S. Pat. No. 2,681,315 (Tongberg, published 15 Jun. 1954) and U.S. Pat. No. 2,833,717 (Whitacre, published 6 May, 1958) teaching lubricating oil compositions containing poly(oxyethylene)alkylphenols useful as rust or corrosion-inhibiting additives.

U.S. Pat. No. 2,921,027 (Brennan 12 Jan. 1960) teaches poly(oxyethylene)sorbitan fatty acid ester as a rust inhibitor.

1,2-poly(oxyalkylene)glycol lubricating compositions are disclosed in U.S. Pat. No. 2,620,302 (Harle, published 2 Dec. 1952), U.S. Pat. No. 2,620,304 (Stewart et al., published 2 Dec. 1952), and U.S. Pat. No. 2,620,305 (Stewart et al., published 2 Dec. 1952).

SUMMARY OF THE INVENTION

The objectives of the present invention include providing at least one of (i) improved sludge handling, (ii) reduced lead or copper corrosion, (iii) increased oxidation resistance, (iv) improved acid control, (v) reduced wear (such as cam wear or lifter wear), (vi) retention of total base number of the lubricant, and/or (vii) improved seal compatibility in an internal combustion engine.

As used herein, reference to the amounts of additives present in the lubricating composition disclosed are quoted on an oil free basis, i.e., amount of actives, unless otherwise indicated.

In one embodiment the present invention provides a lubricating composition comprising an oil of lubricating viscosity, 0.1 wt % to 10 wt % of an overbased detergent, and 0.01 wt % to 5 wt % of a non-hydroxy terminated acylated polyalkylene oxide that does not contain a terminal hydroxyl group. In one embodiment the non-hydroxy terminated acylated polyalkylene oxide may be a non-hydroxy terminated acylated polyalkylene glycol.

The non-hydroxy terminated acylated polyalkylene oxide may be a diester, di-carbamate, a mixed ester-carbamate, or mixtures thereof. Typically the non-hydroxy terminated acylated polyalkylene oxide may be a diester.

The non-hydroxy terminated acylated polyalkylene oxide may be represented by the formula (1):

(1)

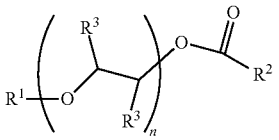

wherein independently each variable $R^1$ may be $C_1$ to $C_{50}$ hydrocarbyl group, —C(O)$R^2$, or —$R^2$;

$R^2$ may be $C_1$ to $C_{50}$ hydrocarbyl group, —$(CH_2)_m$—O—$(CH_2CH_2O)_w$—Y, or X;

X may be —$NH_2$, —$NR^4{}_2$, —$NHR^4$ or —O—$R^4$;

Y may be $C_1$ to $C_{50}$ hydrocarbyl group;

$R^3$ may be $C_{1-4}$ (or $C_{1-2}$) alkyl, or H;

$R^4$ may be $C_1$ to $C_{50}$ hydrocarbyl group;

n may be 2 to 50, or 5 to 30 or 5 to 20, or 5 to 10;

m may be 1 to 20, or 1 to 10, or 1 to 5; and w may be 1 to 20, or 1 to 10, or 1 to 5.

In one embodiment $R^1$ may be $C_1$ to $C_{50}$ hydrocarbyl group, —C(O)$R^2$, or —$R^2$;

$R^2$ may be $C_1$ to $C_{50}$ hydrocarbyl group, —$(CH_2)_m$—O—$(CH_2CH_2O)_w$—Y, or —O—$R^4$;

$R^3$ may be H, or methyl (typically one $R^3$ may be H and second $R^3$ group may be methyl to form propylene group; or both $R^3$ groups are H to form ethylene group), n may be 5 to 10, m may be 1 to 5, and w may be 1 to 5.

In one embodiment $R^1$ may be —C(O)$R^2$;

$R^2$ may be $C_1$ to $C_{50}$ hydrocarbyl group;

$R^3$ may be H, or methyl (typically one $R^3$ may be H and second $R^3$ group may be methyl to form propylene group; or both $R^3$ groups are H to form ethylene group), n may be 5 to 10, m may be 1 to 5, and w may be 1 to 5.

In one embodiment the invention provides a lubricating composition characterised as having at least one of (i) a sulphur content of 0.2 wt % to 0.4 wt % or less, (ii) a phosphorus content of 0.08 wt % to 0.15 wt %, and (iii) a sulphated ash content of 0.5 wt % to 1.5 wt % or less.

In one embodiment the invention provides a lubricating composition characterised as having (i) a sulphur content of 0.5 wt % or less, (ii) a phosphorus content of 0.1 wt % or less, and (iii) a sulphated ash content of 0.5 wt % to 1.5 wt % or less.

The lubricating composition may have a SAE viscosity grade of XW—Y, wherein X may be 0, 5, 10, or 15; and Y may be 20, 30, or 40.

In one embodiment the invention provides a method of lubricating an internal combustion engine comprising supplying to the internal combustion engine a lubricating composition of a lubricating disclosed herein.

The internal combustion engine may have a steel surface on a cylinder bore, a cylinder block, or a piston ring.

The internal combustion engine may be a heavy duty diesel internal combustion engine.

The laden mass (sometimes referred to as gross vehicle weight rating (GVWR)) may be over 2,700 kg (or 6,000 USA pounds) 2,900 kg, or over 3,000 kg, or over 3,300 kg, or over 3,500 kg, or over 3,700 kg, or over 3,900 kg (or 8,500 USA pounds). Typically the upper limit on the laden mass or GVWR is set by national government and may be 10,000 kg, or 9,000 kg, or 8,000 kg, or 7,500 kg.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

There is a distinct difference in size between passenger car, and heavy duty diesel engines. Passenger car engines typically weigh no more than 2610 kg while heavy duty diesel engines typically weigh over 3,500 kg meaning that both types of engines will experience significantly different operating conditions such as load, oil temperatures, duty cycle and engine speeds. Heavy duty diesel engines are designed to maximize torque for hauling payloads at maximum fuel economy while passenger car diesels are designed for transporting people and acceleration at maximum fuel economy. The different designed purpose of these engine (hauling heavy cargo versus transporting people) results in different hardware designs resulting in the need for differently designed lubricants capable of handling the unique stresses imparted to lubricant by the particular class of engine. Another distinct design difference is the operating revolution per minute (RPM) that each engine operates at to haul versus commute. A heavy duty diesel engine such as a typical 12-13 litre truck engine would typically not exceed 2200 rpm while a passenger car engine can go up to 4500 rpm.

The passenger car internal combustion engine may have a reference mass not exceeding 2610 kg.

In one embodiment the invention provides for the use of the non-hydroxy terminated acylated polyalkylene oxide in a lubricating composition disclosed herein to provide at least one of (i) improved sludge handling, (ii) reduced lead or copper corrosion, (iii) increased oxidation resistance, (iv) improved acid control, (v) reduced wear (such as cam wear or lifter wear), (vi) retention of total base number of the lubricant, and/or (vii) improved seal compatibility in an internal combustion engine.

DETAILED DESCRIPTION OF THE INVENTION

The present invention provides a detergent, a process to prepare a detergent, a lubricating composition, a method for lubricating an internal combustion engine and the use as disclosed above.

In one embodiment the lubricating composition defined by the invention is not an emulsion. An emulsion is defined as a colloidal suspension of one immiscible liquid in another, e.g., a water-in-oil, or oil-in-water emulsion.

In one embodiment the lubricating composition defined by the invention is substantially free of, to free of water. By substantially free of, to free of water it is meant that the lubricating composition contains less than 5 wt % water, or less than 1 wt % water, or less than 0.5 wt % water, or less than 0.1 wt % water. Typically any water present may be considered a contaminant amount typically 0 ppb, to less than 500 ppm. Contaminant amounts of water may be present as a result of leakage during internal combustion engine use, or as a result of impurities remaining before, during or after preparation of the lubricating composition.

Non-Hydroxy Terminated Acylated Polyalkylene Oxide

The non-hydroxy terminated acylated polyalkylene oxide may be characterized in that at least one terminus of the molecule comprises an acyl group, such as an ester or a carbamate. The other terminus of the molecule may be selected such that it is not a hydroxyl group (i.e. —OH). In one embodiment, the non-hydroxy terminated acylated polyalkylene oxide comprises an ester-ether compound, that is, the polyalkylene oxide is terminated at one end with ester functionality and at the other end it is terminated with an ether group.

In one embodiment, the non-hydroxy terminated acylated polyalkylene oxide is terminated at both ends with acyl-containing functional groups. A polyalkylene glycol terminated at both ends with acyl functionality may comprise a di-ester, a di-carbamate, or even a mixed ester-carbamate. In one embodiment, the non-hydroxy terminated acylated polyalkylene oxide is terminated with ester groups at both ends, i.e. it is a di-ester compound.

The non-hydroxy terminated acylated polyalkylene oxide of the invention may be present in the lubricating composition in an amount ranging from 0.05 wt % to 4 wt %, or 0.05 wt % to 3 wt %, or 0.1 wt % 2 wt %, or 0.2 to 1.5 wt % of the lubricating composition. The non-hydroxy terminated acylated polyalkylene oxide may be present at 0.2 wt % to 1 wt % of the lubricating composition.

The non-hydroxy terminated acylated polyalkylene oxide may comprise 1 to 5, or 1 to 3, or 1 to 2 carbonyl groups.

The non-hydroxy terminated acylated polyalkylene oxide may be according to formula (1), wherein $R^1$ and $R^2$ may be linear or branched, or cyclic. $R^1$ and $R^2$ may independently be $C_1$ to $C_{12}$, or $C_1$ to $C_8$ hydroacarbyl groups. $R^1$ and $R^2$ may independently be alkyl or aryl groups.

In one embodiment $R^1$ may be $C_1$-to $C_{20}$ or $C_{10}$ to $C_{20}$ alk(en)yl group (that is, alkyl or alkenyl) and $R^2$ may be an aryl group (such as phenyl group).

In one embodiment n may be 5 to 10, and w may be 1 to 5.

The non-hydroxy terminated acylated polyalkylene oxide may be prepared by a process comprising reacting an isocyanate or diisocyanate with a hydroxyl-terminated polyalkylene glycol (or oxide) in a mole ratio of 3:1 to 1:3, or 2:1 to 1:2, or 1:1.

The non-hydroxy terminated acylated polyalkylene oxide may be prepared by a process comprising reacting a carboxylic acid (with a $R^2$ group) with a hydroxyl-terminated polyalkylene glycol (or oxide) in a mole ratio of 3:1 to 1:3, or 2:1 to 1:2, or 1:1.

The reaction conditions to prepare the non-hydroxy terminated acylated polyalkylene oxide may include a reaction temperature of 120° C. to 200° C., or 150° C. to 180° C.

The reaction may be carried out in the absence or presence of a catalyst. Examples of a suitable catalyst include methane sulfonic acid, toluene or sulfonic acid.

The reaction may be prepared in the absence or presence of solvent. Suitable solvents may include oil of lubricating viscosity, i.e., 2 $mm^2/s$ (cSt) to 30 $mm^2/s$, toluene, or xylene. In one embodiment, the reaction is carried out in the absence of a solvent, i.e. neat.

Examples of isocyanates include cyclohexyl isocyanate, methyl isocyanate, ethyl isocyanate, propyl isocyanate, butyl isocyanate, pentylisocyanate, hexylisocyanate, heptylisocyanate, octylisocyanate, nonylisocyanate, decylisocyanate, undecyl isocyanate, dodecyl isocyanate, tridecyl isocyanate, tetradecyl isocyanate, pentadecyl isocyanate, hexadecyl isocyanate, heptadecyl isocyante, ocatadecyl isocyanate, nonadecyl isocyanate, allyl isocyanate, phenyl isocyanate, and its derivatives, such as benzyl isocyanate, tolyl isocyanate, ethylphenyl isocyanate, chlorophenyl isocyanate, or naphthyl isocyanate.

Examples of diisocyanates include isophorone diisocyanate, methylene-di-p-phenyl-diisocyanate, methylenediisocyanate, ethylene-diisocyanate, diisocyanatobutane, diisocyanatohexane, cyclohexylene diisocyanate, or toluene diisocyanate.

Example of carboxylic acids include acidic acid, propionic acid, pentanoic acid, hexanoic acid, pentanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, docosanoic acid, tricosanoic acid, tetracosanoic acid, oleic acid, linolenic acid, or linoleic acid.

The hydroxyl-terminated polyalkylene glycol may include homopolymers or copolymers of hydroxyl-terminated ethylene glycol, propylene glycol, butylene glycol, or mixtures thereof.

Examples of hydroxyl-terminated polyalkylene glycol include dihydroxyl-terminated polyalkylene glycol as well as monohydroxyl-terminated alkoxylated alcohols. Dihydroxyl-terminated polyalkylene glycol and monohydroxyl-terminated alkoxylated alcohols are known in the art and are commercially available from company such as BASF, Dow, Huntsman, and Sasol. For example, Dow sell products under the tradename of UCON™ OSP formulated fluids and lubricants and base stocks (see brochure entitled "UCON™ OSP Base Fluids, Oil-soluble polyalkylene glycol lubricant technology", Form Number 816-00039-0211X AMS, published February 2011). Dow also sell products under the tradename of UCON™ LB Fluids (advertised as LB Fluids are alcohol-started base stocks featuring oxypropylene groups (m=0) with one terminal hydroxyl group. They are water insoluble and available in a variety of molecular weights and viscosities), as well as SYNALOX® Fluids and Lubricants that may be useful too.

The number average molecular weight of the hydroxyl-terminated polyalkylene glycol may vary from 700 to 10,000, or 1000 to 5,000.

Overbased Detergent

The overbased metal-containing detergent may be selected from the group consisting of non-sulphur containing phenates, sulphur containing phenates, sulphonates, salixarates, salicylates, and mixtures thereof, or borated equivalents thereof. The overbased detergent may be borated with a borating agent such as boric acid.

The overbased detergent may be selected from the group consisting of non-sulphur containing phenates, sulphur containing phenates, sulphonates, salixarates, salicylates, and mixtures thereof.

The overbased detergent may be non-sulphur containing phenates, sulphur containing phenates, sulphonates.

The metal of the metal-containing detergent may be an alkali metal, an alkaline earth metal, or zinc. In one embodiment the metal is sodium, calcium, barium, or magnesium. Typically the metal of the metal-containing detergent may be sodium, calcium, or magnesium.

Typically the overbased metal-containing detergent may be a calcium or magnesium overbased detergent.

The overbased metal-containing detergent may also include "hybrid" detergents formed with mixed surfactant systems including phenate and/or sulphonate components, e.g., phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be sodium, calcium or magnesium salt of the phenates, sulphur containing phenates, sulphonates, salixarates and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of U.S. Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of U.S. Patent Application 2008/0119378.

Overbased detergents are known in the art. Overbased materials, otherwise referred to as overbased or superbased salts, are generally single phase, homogeneous Newtonian systems characterised by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

The overbased detergent may be present at 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition comprises at least one overbased detergent with a metal ratio of at least 3, or at least 8, or at least 15.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in U.S. Patent Application 2010/197536, see [0072] to [0073]). A more detailed description of natural and synthetic lubricating oils is described in paragraphs [0058] to [0059] respectively of WO2008/147704 (a similar disclosure is provided in U.S. Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricating composition may be prepared by adding the non-hydroxy terminated acylated polyalkylene oxide and overbased detergent described herein to an oil of lubricating viscosity, optionally in the presence of other performance additives (as described herein below).

The lubricating composition of the invention may further include other additives. In one embodiment the invention provides a lubricating composition further comprising at least one of a dispersant, an antiwear agent, a dispersant viscosity modifier, a friction modifier, a viscosity modifier, an antioxidant, an overbased detergent, a foam inhibitor, a demulsifier, a pour point depressant or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the invention does include a dispersant or mixtures thereof. The dispersant may be present as a single dispersant. The dispersant may be present as a mixture of two or more (typically two or three) different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in U.S. Patent Application US2009/0054278.

In one embodiment the dispersant may be borated or non-borated. Typically a borated dispersant may be a succinimide dispersant. In one embodiment, the ashless dispersant is boron-containing, i.e., has incorporated boron and delivers said boron to the lubricant composition. The boron-containing dispersant may be present in an amount to deliver at least 25 ppm boron, at least 50 ppm boron, or at least 100 ppm boron to the lubricant composition. In one embodiment, the lubricant composition is free of a boron-containing dispersant, i.e. delivers no more than 10 ppm boron to the final formulation.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B.C. Trivedi and B.C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

The dispersant may be present at 0 wt % to 20 wt %, 0.1 wt % to 15 wt %, or 0.5 wt % to 9 wt %, or 1 wt % to 8.5 wt % of the lubricating composition.

In one embodiment the lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Antioxidants include sulphurised olefins, diarylamines, alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butyl-phenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalised with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and U.S. Pat. No. 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

In one embodiment the friction modifier may be selected from the group consisting of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartaric acid derivatives such as tartrate esters, amides or tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in U.S. Patent Application 20050198894.

The lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In one embodiment the titanium (IV) carboxylate is titanium neodecanoate.

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof different from the non-hydroxy terminated acylated polyalkylene oxide of the invention.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulpholene derivatives Exxon Necton-37™ (FN 1380) and Exxon Mineral Seal Oil™ (FN 3200).

An engine lubricating composition in different embodiments may have a composition as disclosed in the following table:

| | Embodiments (wt %) | | |
|---|---|---|---|
| Additive | A | B | C |
| non-hydroxy terminated acylated polyalkylene oxide | 0.05 to 3 | 0.1 to 2 | 0.2 to 1.5 |
| Overbased Detergent | 2 to 9 | 3 to 8 | 3 to 5 |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an exhaust gas recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine). In one embodiment the internal combustion engine is a 4-stroke engine.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.2 wt % or 1.1 wt % of the lubricating composition. In one embodiment the sulphated ash content may be 0.5 wt % to 1.2 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application U.S. 2010-0197536.

The following examples provide illustrations of the invention. These examples are non-exhaustive and are not intended to limit the scope of the invention.

EXAMPLES

Acylated polyethylene glycols are used as purchased from Sigma-Aldrich. Additive A (ADD A) is O,O'-Dioleoylpolyethylene glycol 400 (also called poly(ethylene glycol) dioleate) with a molecular formula of $C_{17}H_{34}C(=O)—O—[—CH_2CH_2O—]_8—C(=O)C_{17}H_{34}$; additive B (ADD B) is Poly(ethylene glycol) bis(2-ethylhexanoate) (molecular formula $C_7H_{14}C(=O)—O—[—CH_2CH_2O—]_8—C(=O)C_7H_{14}$); additive C (ADD C) is Poly(ethylene glycol) dilaurate (molecular formula $C_{11}H_{23}C(=O)—O—[—CH_2CH_2O—]_8—C(=O)C_{11}H_{23}$). Comparative additive D (ADD D) is Poly(ethylene glycol) monolaurate (molecular formula $C_{11}H_{23}C(=O)—O—[—CH_2CH_2O—]_8—H$).

A series of 5W-30 engine lubricants in Group II base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives as follows (Table 1). The phosphorus, and sulfur contents of each of the examples are also presented in the table in part to show that each example has a similar amount of these materials and so provide a proper comparison between the comparative and invention examples.

TABLE 1

Lubricating Oil Composition Formulations[1]

| | CL1 | IE1 | CL2 | IE2 |
|---|---|---|---|---|
| Group II Base Oil | Balance to 100% | Balance to 100% | Balance to 100% | Balance to 100% |
| ADD A | | 0.2 | | |
| ADD B | | | | 1.0 |
| Ca Detergent[2] | 0.74 | 0.74 | 0.74 | 0.74 |
| ZDDP (2°) | 0.77 | 0.77 | 0.77 | 0.77 |
| Antioxidant[3] | 1.45 | 1.45 | 2.15 | 2.15 |
| Dispersant[4] | 2.12 | 2.12 | 2.12 | 2.12 |
| Viscosity Modifier[5] | 0.63 | 0.63 | 0.76 | 0.76 |
| Additional additives[6] | 0.28 | 0.28 | 0.28 | 0.28 |
| % Phosphorus | 0.070 | 0.075 | 0.075 | 0.077 |
| % Sulfur | 0.20 | 0.21 | 0.22 | 0.24 |
| KV100 (cSt) | 10.6 | 10.4 | 10.0 | 10.5 |
| CCS −30 C. (cP) | 6400 | 6400 | 5570 | 5840 |

[1]All amounts shown above are in weight percent and are on an oil-free basis unless otherwise noted.
[2]Combination of 500 TBN overbased sulfonate and 680 TBN overbased sulfonate
[3]Combination of hindered phenol, diarylamine, and sulfurized olefin
[4]Polyisobutylene succinimide
[5]Ethylene-propylene copolymer
[6]The additional additives used in the examples include, sodium sulfonate, ashless friction modifiers, and an antifoam agent, and include some amount of diluent oil.

CL1, IE1, CL2, and IE2 are evaluated in the Sequence IIIG engine test for 100 hours. The Sequence IIIG engine test simulates high-speed service during relatively high ambient conditions; it measures oil thickening and piston deposits operation and provides information about valve train wear. Lubricants subjected to the Sequence IIIG are evaluated for many parameters including end of test viscosity increase, valve train wear, and oil consumption. In addition, acid number (TAN) and base number (TBN) are monitored throughout the test at 20 hour intervals. The results obtained are summarized in Table 2.

TABLE 2

Sequence IIIG Engine Test Results

| | CL1 | IE1 | CL2 | IE2 |
|---|---|---|---|---|
| Viscosity Increase @ 100° C. EOT (%) | 134.2 | 94 | 102 | 79.5 |
| Average Cam + Lifter Wear (μm) | 25.3 | 14.9 | 34.6 | 27.8 |

TABLE 2-continued

Sequence IIIG Engine Test Results

| | CL1 | IE1 | CL2 | IE2 |
|---|---|---|---|---|
| Oil Consumption (L) | 4.42 | 3.6 | 4.08 | 3.42 |
| TAN[1] $T_{20}$ | 1.8 | 2.0 | 1.8 | 2.0 |
| TAN $T_{40}$ | 2.9 | 2.5 | 2.9 | 2.6 |
| TAN $T_{60}$ | 3.5 | 3.3 | 3.5 | 3.4 |
| TAN $T_{80}$ | 4.8 | 2.9 | 5.2 | 3.9 |
| TAN $T_{100}$ | 13.8 | 4.0 | 6.9 | 4.5 |
| TBN[2] $T_{20}$ | 2.6 | 3.3 | 3.4 | 3.4 |
| TBN $T_{40}$ | 2.3 | 2.5 | 2.4 | 2.6 |
| TBN $T_{60}$ | 2.1 | 2.2 | 2.1 | 2.4 |
| TBN $T_{80}$ | 1.9 | 1.5 | 1.7 | 2.1 |
| TBN $T_{100}$ | 0.4 | 1.8 | 1.1 | 1.9 |

[1]TAN measured by ASTM D664
[2]TBN measured by ASTM D4739 (buffer)

The results indicate that the addition of the non-hydroxy terminated acylated polyalkylene oxide of the present invention is capable of reducing oxidation of lubricant, reducing wear and reducing the total acid number at the end of the engine test compared with a comparative lubricant not containing the non-hydroxy terminated acylated polyalkylene oxide.

An additional set of 5W-30 engine lubricants in Group III base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives as follows (Table 3).

TABLE 3

Lubricating Oil Composition Formulations[1]

| | CL3 | IE3 |
|---|---|---|
| Group II Base Oil | Balance to 100% | Balance to 100% |
| ADD C | | 0.5 |
| ADD D | 0.5 | |
| Ca Detergent[2] | 1.45 | 1.45 |
| ZDDP (2°) | 0.45 | 0.45 |
| Antioxidant[3] | 2.00 | 2.00 |
| Dispersant[4] | 4.90 | 4.90 |
| Viscosity Modifier[5] | 1.23 | 1.23 |
| Additional additives[6] | 0.36 | 0.36 |
| % Phosphorus | 0.046 | 0.045 |
| % Sulfur | 0.18 | 0.18 |
| KV100 (cSt) | 11.74 | 11.76 |
| CCS −30 C. (cP) | 6090 | 6050 |

[1]All amounts shown above are in weight percent and are on an oil-free basis unless otherwise noted.
[2]Combination of 680 TBN overbased sulfonate, and overbased sulphur coupled phenates
[3]Combination of hindered phenol and diarylamine
[4]Polyisobutylene succinimide
[5]Styrene-butadiene block copolymer
[6]The additional additives used in the examples include, ashless friction modifiers, and an antifoam agent, corrosion inhibitor, and include some amount of diluent oil.

CL3 and IE3 are evaluated in an oxidation bench test as well as the ASTM D6594 Cummins high temperature corrosion bench test (HTCBT) and the DBL6674_FKM Mercedes-Benz fluoroelastomer seals bench test. In the oxidation bench test, the test lubricant (50 g) is bubbled with 50 cc/min of air in an oil bath at 165 c for 148 hours with a copper coupon. The end of test (EOT) drain is analyzed for ppm copper, TBN and TAN. The results obtained are summarized in Table 4.

TABLE 4

| Oxidation Bench test | | | | |
|---|---|---|---|---|
| Lubricant | | | CL3 | IE3 |
| OXDN | TAN[1] | SOT | 1.3 | 1.4 |
| BENCH | | EOT | 5.4 | 2.7 |
| TEST | TBN[2] | SOT | 5.7 | 5.8 |
| | | EOT | 0.3 | 2.1 |
| | Cu (ppm) | EOT | 218 | 64 |
| HTCBT | Cu (ppm) | | 57 | 14 |
| | Pb (ppm) | | 1580 | 178 |
| SEALS | % Tensile Strength | | −38 | −27 |
| | % Rupture Elongation | | −44 | −33 |

[1]TAN is measured by D6664
[2]TBN is measured by D2896

The results indicate that when comparing a lubricant containing a polyalkylene glycol having a terminal hydroxyl group (CL3) to a lubricant of the present invention (i.e., an non-hydroxy terminated acylated polyalkylene oxide having no terminal hydroxyl group) (IE3), the presently claimed invention provides a lubricant with improved TAN control and TBN retention that also reduces copper and lead corrosion without having a deleterious effect on seals compatibility. This suggests that the presently claimed invention provides at least one of (i) improved sludge handling, (ii) reduced lead or copper corrosion, (iii) increased oxidation resistance, (iv) improved acid control, (v) reduced wear (such as cam wear or lifter wear), (vi) retention of total base number of the lubricant, and/or (vii) improved seal compatibility in an internal combustion engine compared with a lubricant containing a polyalkylene glycol having a terminal hydroxyl group. The inventive lubricant is also able to retain total base number better than the comparative lubricant.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity, 0.1 wt % to 10 wt % of an overbased detergent, and 0.01 wt % to 5 wt % of a non-hydroxy terminated acylated polyalkylene oxide represented by the formula:

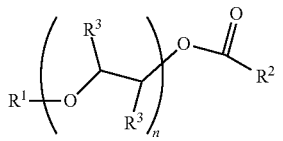

wherein independently each variable $R^1$ and $R^2$ are independently $C_1$ to $C_{12}$ hydrocarbyl groups;

one $R^3$ is H and the other $R^3$ group is methyl;

n in 2 to 50;

wherein the lubricating composition has a sulphated ash content of 0.5 wt % to 1.5 wt %.

2. The lubricating composition of claim 1, wherein $R^1$ and $R^2$ are independently $C_1$ to $C_8$ hydrocarbyl groups.

3. The composition of claim 1 wherein the non-hydroxy terminated acylated polyalkylene oxide is prepared by a process comprising reacting a carboxylic acid with a hydroxyl-terminated polyalkylene glycol in a mole ratio of 3:1 to 1:3.

4. The composition of claim 1 wherein the overbased detergent is selected from the group consisting of non-sulphur containing phenates, sulphur containing phenates, sulphonates, salixarates, salicylates, and mixtures thereof.

5. The composition of claim 1 wherein the overbased detergent is non-sulphur containing phenates, sulphur containing phenates, sulphonates and mixtures thereof.

6. The composition of claim 1 wherein the overbased detergent is present at 3 wt % to 8 wt % of the lubricating composition.

7. The composition of claim 1 wherein the overbased detergent is present at 0.15 wt % to less than 3 wt % of the lubricating composition.

8. The composition of claim 1 wherein the lubricating composition comprises (i) a sulphur content of 0.5 wt % or less, and (ii) a phosphorus content of 0.1 wt % or less.

9. The composition of claim 1 wherein the lubricating composition comprises at least one of (i) a sulphur content of 0.2 wt % to 0.4 wt %, and (ii) a phosphorus content of 0.08 wt % to 0.15 wt %.

10. The composition of claim 1 wherein the lubricating composition comprises a sulphated ash content of 0.5 wt % to 1.2 wt %.

11. A method of lubricating an internal combustion engine comprising supplying to the internal combustion engine a lubricating composition of claim 1.

12. The method of claim 11 wherein the internal combustion engine is a heavy duty diesel internal combustion engine.

13. The method of claim 11 wherein the internal combustion engine is a passenger car internal combustion engine.

* * * * *